US005909936A

United States Patent [19]

Daniels et al.

[11] Patent Number: 5,909,936

[45] Date of Patent: Jun. 8, 1999

[54] CLOSET DRAWER SYSTEM

[75] Inventors: Mark Daniels; Pam Smith, both of Ocala, Fla.; Steve McPhilliamy; John VanAkkeren, both of Chicago, Ill.; Damon Johnston, Oswego, Ill.; Mike Jaron, Mt. Prospect, Ill.

[73] Assignee: Clairson, Inc., Newark, Del.

[21] Appl. No.: 08/908,203

[22] Filed: Aug. 7, 1997

[51] Int. Cl.[6] ..... A47B 88/00

[52] U.S. Cl. ..... 312/334.1; 312/257.1; 312/108; 211/90.01

[58] Field of Search ..... 312/107, 108, 312/245, 257.1, 334.1; 211/86.01, 90.01, 187, 153, 186, 113; 108/152, 109, 180, 42; D6/524, 525, 528, 560, 467

[56] References Cited

U.S. PATENT DOCUMENTS

| | | | |
|---|---|---|---|
| D. 287,682 | 1/1987 | Sussman | D6/524 |
| D. 294,096 | 2/1988 | Murphy | D6/560 |
| 1,916,852 | 7/1933 | Sutton . | |
| 2,657,968 | 11/1953 | Soehner | 312/330.1 |
| 2,999,599 | 9/1961 | Jantzen | 312/245 X |
| 3,200,962 | 8/1965 | Davelaar | 312/111 X |
| 3,393,031 | 7/1968 | Morrill | 312/257.1 X |
| 3,634,983 | 1/1972 | Welch | 211/90.01 X |
| 3,828,937 | 8/1974 | Nash | 211/86 |
| 3,898,939 | 8/1975 | Grachten | 108/109 |
| 4,192,562 | 3/1980 | Bishoff et al. | 312/108 |
| 4,206,955 | 6/1980 | Cooper | 312/108 X |
| 5,163,568 | 11/1992 | Laurendeau et al. | 211/187 |
| 5,407,084 | 4/1995 | Remmers | 211/183 |
| 5,605,238 | 2/1997 | Jacobs | 211/90 |

FOREIGN PATENT DOCUMENTS

| | | |
|---|---|---|
| 651719 | 2/1929 | France . |
| 1085094 | 1/1955 | France . |
| 2315239 | 1/1977 | France . |

*Primary Examiner*—Peter M. Cuomo
*Assistant Examiner*—James O. Hansen
*Attorney, Agent, or Firm*—McDermott, Will & Emery

[57] ABSTRACT

A closet drawer system which includes a back support member having an opening utilized to secure the back support member to a surface, and cavities disposed on opposite ends thereof; and first and second side support members having a projection disposed on a first end, which are operable with the cavities of the back support member so as to secure the first and second side support members to the back support member. Each of the side support members includes a second end formed so as to be operable as a latch receiving section. The closet drawer system further includes a first and second latch member, each of which is operable with one of the latch receiving sections so as to secure the second end of the side support members to a support structure.

17 Claims, 6 Drawing Sheets

CLOSET DRAWER SYSTEM

BACKGROUND OF THE INVENTION

1. Field of the Invention

The present invention relates to a closet drawer system for forming slidable storage units, and more specifically, to a closet drawer system that exhibits a simplified mounting mechanism and which is compatible with standard closet organizers.

2. Description of Related Art

Numerous devices have been developed for forming modular slidable drawers suitable for mounting to a wall and a closet pole organizer. For example, U.S. Pat. No. 5,605,238 ("the '238 patent") discloses a known modular shelving system. As illustrated in FIGS. 1 and 2 of the '238 patent, the system comprises vertical support members 20 which function to support shelve brackets 24. The rear end of the shelve bracket 24 is typically secured to a wall, while the front end of the bracket 24 is secured to a block assembly 23. As shown, the front end of the bracket 24 is secured to the support member 20 via multiple hardware components, including the block assemblies 23, washers 33 and numerous screws, which are necessary to secure the block assemblies to the vertical support members 20, and to secure the shelve brackets 24 to the block assemblies 23.

While such known systems provide the flexibility of modular units, they suffer from significant drawbacks. Foremost, such systems are not easy to assemble. Indeed, in order to assemble a single drawer, a significant amount of hardware must be handled and assembled. Further, for the same reason, such systems are not readily reconfigurable. For example, in order to relocate a drawer, a significant amount of hardware must be disassembled and then reassembled. Finally, as all of the components are typically pre-drilled at the factory, often times alignment problems arise when the consumer attempts to assemble the unit. Such alignment problems can prevent the consumer from assembling the system, if the consumer does not have the capability of redrilling the necessary holes.

Accordingly, there remains a need for a closet drawer system which eliminates the foregoing problems of known modular drawer systems, and which is compatible with existing standard closet organizers, such as that shown in the '238 patent.

SUMMARY OF THE INVENTION

The present invention relates to a closet drawer system that satisfies the aforementioned deficiencies in the prior art. More specifically, the present invention relates to a modular closet drawer system which minimizes the amount of hardware necessary to assemble each drawer, which eliminates the possibility of misalignment problems arising during the assembly process, and which is compatible with standard closet organizers.

In one exemplary embodiment, the closet drawer system comprises a back support member having an opening utilized to secure the back support member to a surface, and cavities disposed on opposite ends thereof; and first and second side support members having a projection disposed on a first end, which are operable with the cavities of the back support member so as to secure the first and second side support members to the back support member. Each of the side support members comprises a second end formed so as to be operable as a latch receiving section. The closet drawer system further includes a first and second latch member, each of which is operable with one of the latch receiving sections so as to secure the second end of the side support members to a support structure.

The present invention provides important advantages over the prior art. Most importantly, the novel design of the present invention allows the drawer system to be compatible with standard closet organizers.

Another advantage is that the design of the present invention minimizes the amount of hardware necessary to assemble and mount each drawer. The present invention also simplifies the process of reconfiguring the drawers.

Yet another advantage is that the present invention eliminates the possibility of misalignment problems arising during the assembly process.

Additional advantages of the present invention will become apparent to those skilled in the art from the following detailed description of an exemplary embodiment, which exemplifies the best mode of carrying out the invention.

The invention itself, together with further objects and advantages, can be better understood by reference to the following detailed description and the accompanying drawings.

DETAILED DESCRIPTION OF THE PRESENT INVENTION

Figure 1:
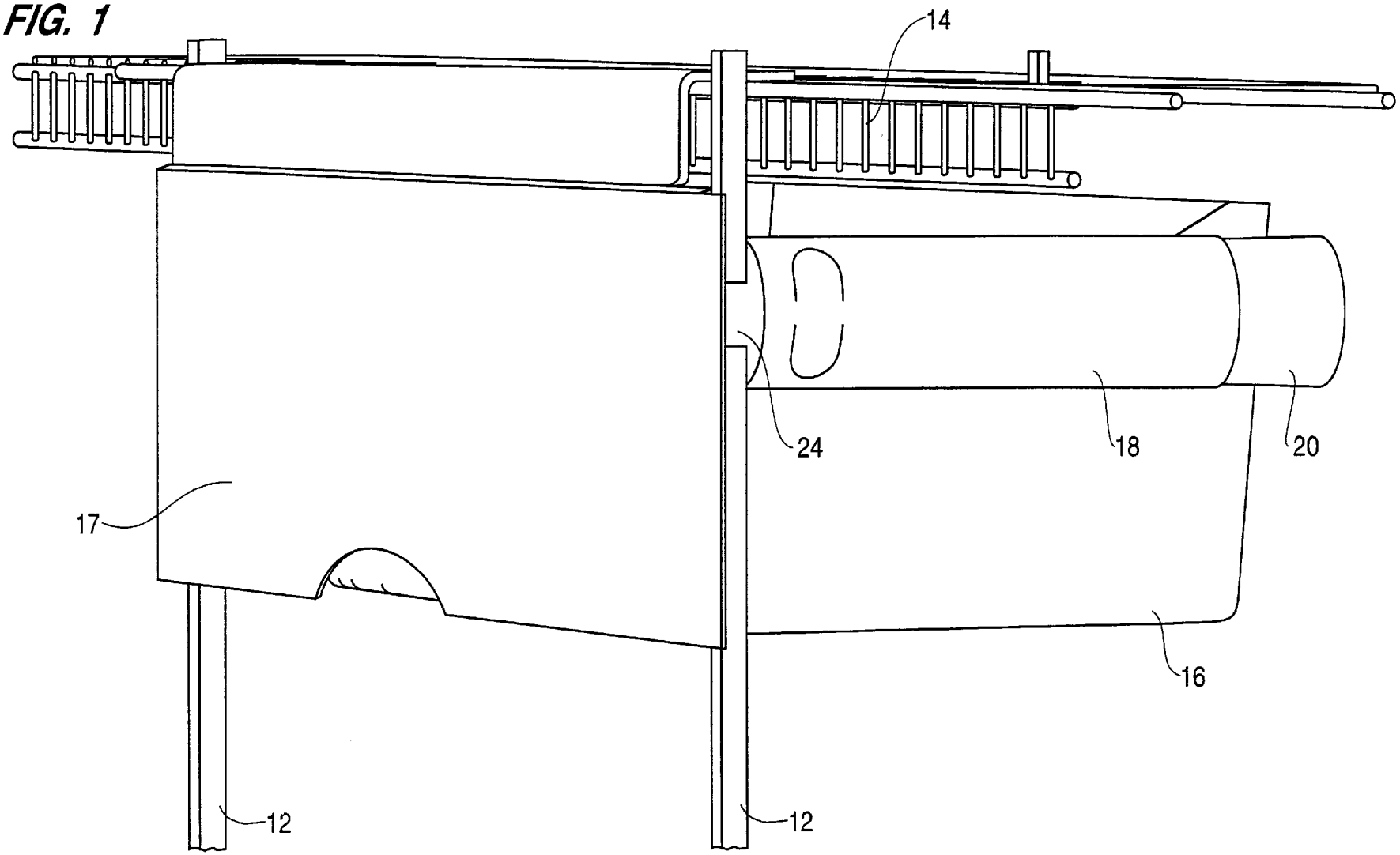
FIG. 1 illustrates an exemplary embodiment of the closet draw system of the present invention in the assembled state.

FIG. 1 illustrates an exemplary embodiment of the closet draw system of the present invention integrated with a standard closet organizer. Referring to FIG. 1, the components of the standard closet organizer include vertical support poles 12 and the wire mesh 14, which is typically utilized as a shelf. As explained in more detail below, the components of the present invention include a drawer 16 having a front face 17, a first and second side support member 18 (only one is shown), and back support member 20 having first and second cavities 21, 22 for receiving projections (not shown) disposed on the side support members 18, and latch members 24 which operate in conjunction with latch receiving sections (not shown) disposed on the first and second side support members 18 to secure the side support members 18 to the support poles 12.

Figure 6:
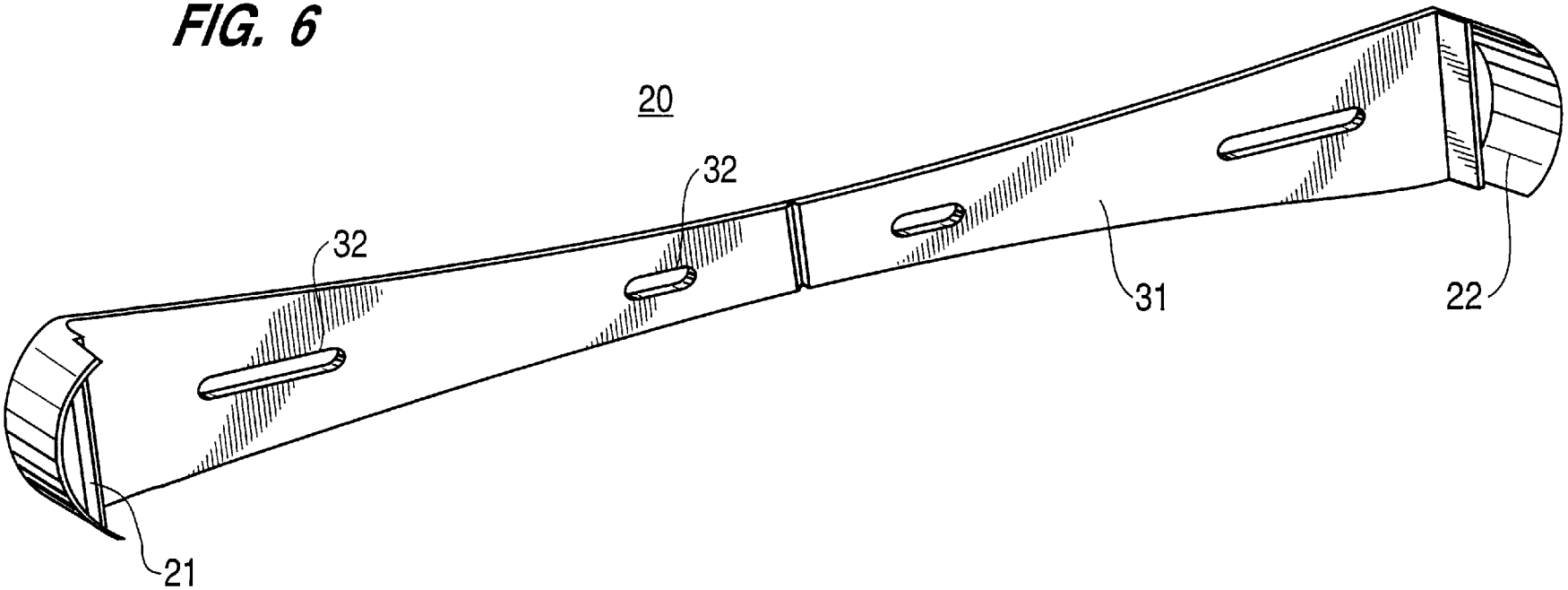
FIG. 6 illustrates an exemplary embodiment of a back support member.

More specifically, the structure of the closet drawer system of the present invention is as follows. The back support member 20 functions as an anchor which secures the unit to a structure such as a closet wall. In particular, the back support member 20 operates as a support for the rear portions of the side support members 18. As shown in FIG. 6, in one embodiment the back support member 20 comprises a substantially flat elongated surface 31 having a plurality of slots 32 disposed therein. The slots 32 provide a mechanism for securing the member 20 to the wall surface, which is typically accomplished via screws.

In the preferred embodiment, each end of the back support member 20 further comprises a cavity 21, 22 operative for receiving projections 45 formed on the side support members 18. As shown, the cavities 21, 22 extend substantially perpendicular to the longitudinal axis of the surface 31, in substantially the same direction, such that once inserted, the side support members 18 extend substantially parallel to one another. The dimensions of the cavities 21, 22 and the corresponding projections 45 are such that the projections 45 once inserted into the corresponding cavity 21, 22 cannot be removed without applying force. Thus, as stated, the back support member 20 function as a support member for the side support members 18.

Figure 3A:
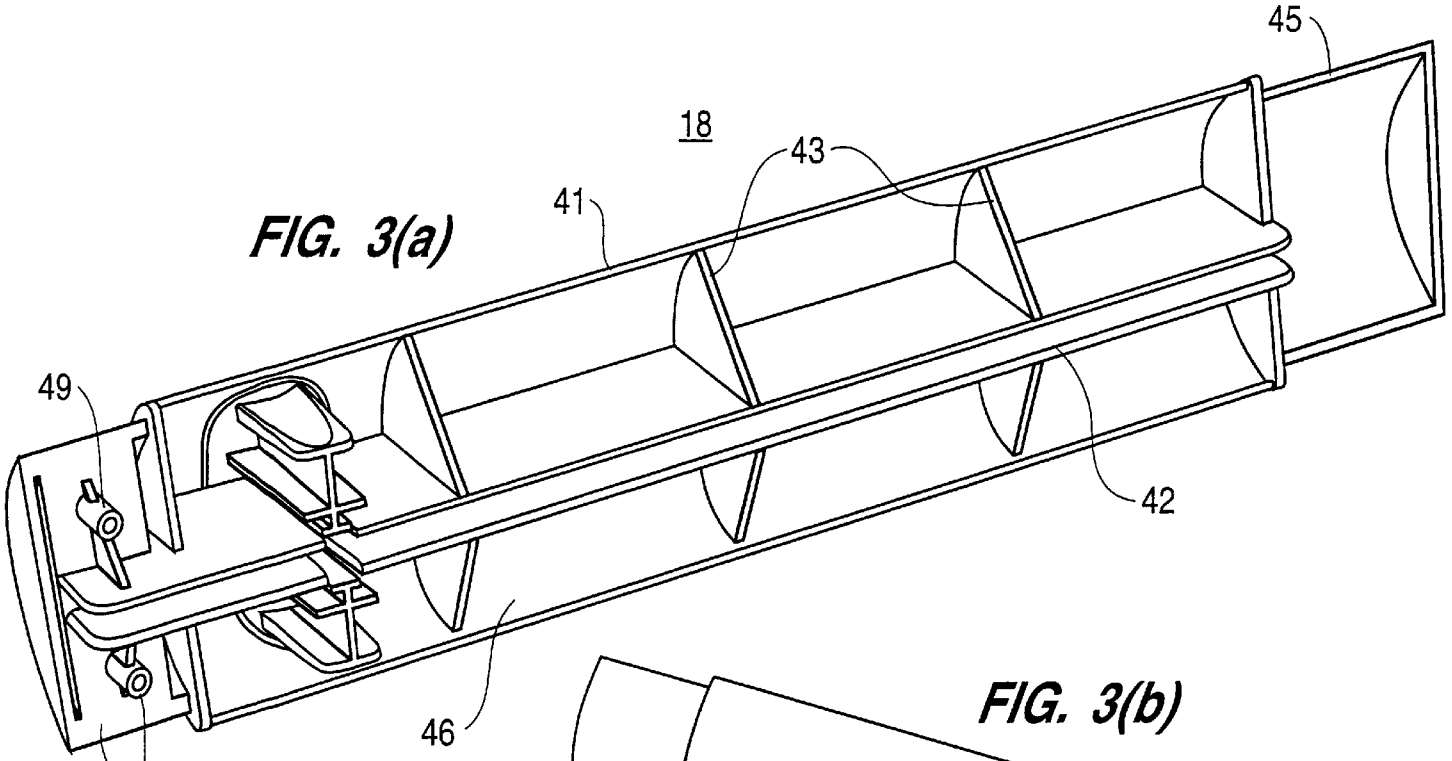
FIGS. 3 (*a*) and (*b*) illustrate an exemplary embodiment of a side support-member.
Figure 3B:
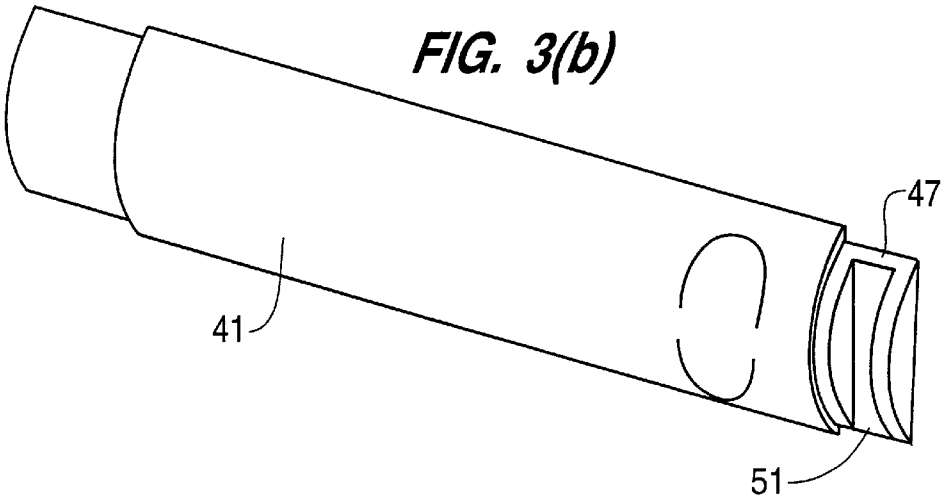

FIGS. 3(*a*) and 3(*b*) illustrate one embodiment of a side support member 18. Referring to FIG. 3(*a*), which illustrates the inner surface 46 of the side support member 18 comprising an arcuate shell 41 having a longitudinal guide channel 42 disposed therein. Preferably, the guide channel 42 is secured to the shell 41 and supported by multiple members 43.

As already mentioned, each side support member 18 also comprises a projection 45 extending from one end thereof. As shown, in FIGS. 3(*a*) and 3(*b*), in the preferred embodiment, each projection 45 extends parallel to the longitudinal plane of the side support member 18, and has a shape such that it can be secured within the corresponding cavity 21, 22 on the back support member 20 without the need for any additional hardware.

Furthermore, in the preferred embodiment, the design of the side support member 18 is universal, meaning that there is no distinction between left and right side support members (i.e., the same side support member can function as either the right or left side support member).

Once the side support members 18 are inserted into the cavities 21, 22 formed on the back support member 20, the inner surfaces 46 of the side support members 18 will oppose one another. Moreover, the interconnection between the projections 45 and the cavities 21, 22 functions to level and align the side support members 18 such that the channel guides 42 on the opposing inner surfaces 46 extend substantially parallel to one another. Once the assembly is complete, the channel guides 42 function as a glide surface for the drawer 16.

Each side support member 18 further comprises a latch receiving section 47, preferably disposed on the end of the member 18 opposite the end on which the projection 45 is formed. Referring to FIG. 3(*a*), on the inner surface thereof, the latch receiving section 47 comprises an extension of the guide channel 42, and two openings 49 operative for receiving tension screws.

Referring to FIG. 3(*b*), on the outer surface thereof, the latch receiving section 47 comprises a channel 51 for receiving the vertical support pole 12. In other words, the dimensions of the channel 51 are such that the support pole 12, which can exhibit numerous shapes (e.g., square, round, etc.) fits within the channel 51. As explained below, the latch receiving section 47 operates in conjunction with the latch member 24 to secure the side support member 18 to the vertical support pole 12.

Figure 4:
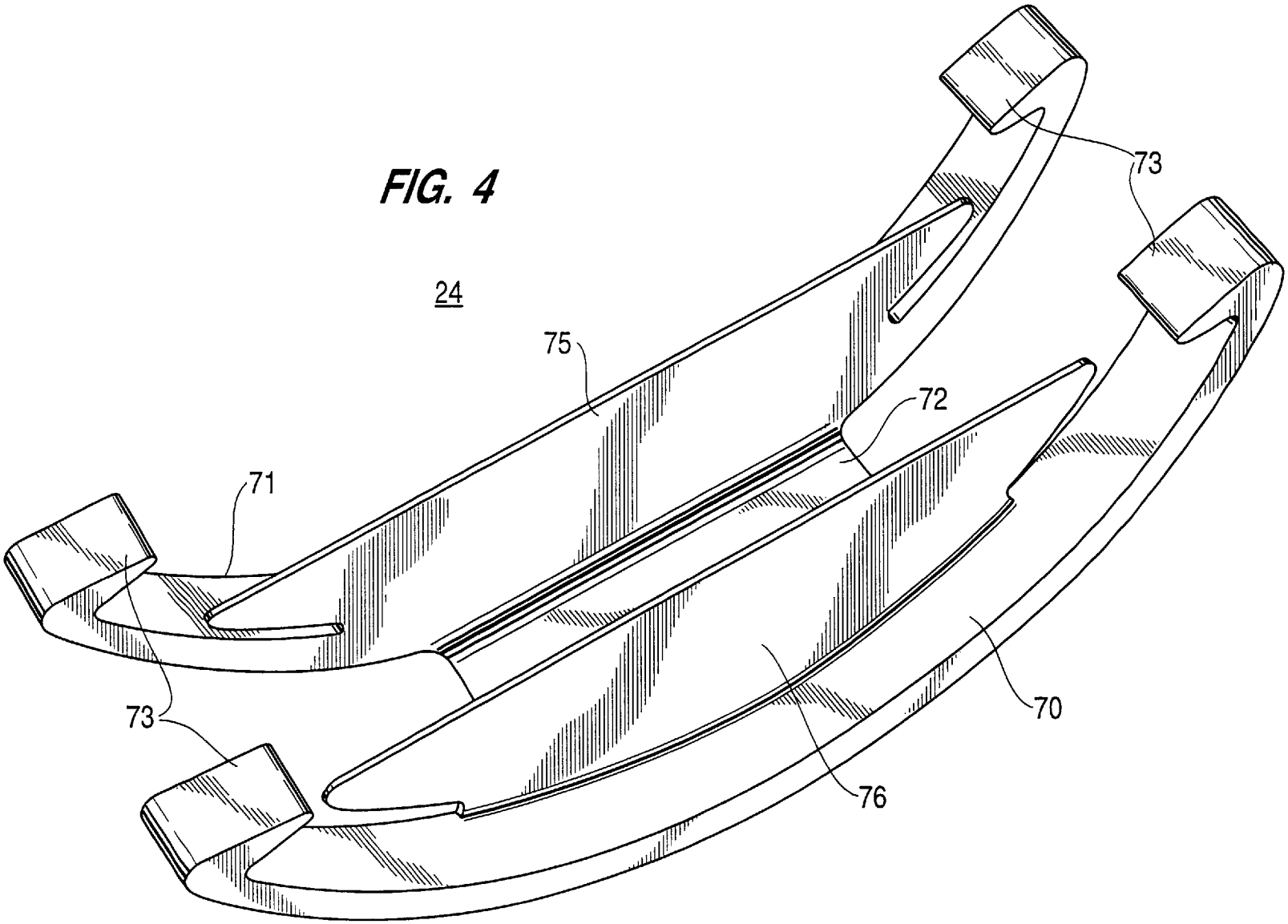
FIG. 4 illustrates an exemplary embodiment of a latch member designed in accordance with the present invention.

FIG. 4 illustrates one embodiment of the latch member 24 of the present invention. As shown, the latch member 24 comprises two arcuate members 70, 71 coupled together via a middle section 72. Each end of the arcuate members 70, 71 comprises a hook 73. Importantly, the latch member 24 is formed from a resilient material, preferably polypropylene. The latch member 24 also comprises side members 75, 76 extending downwardly from the arcuate members 70, 71.

Figure 5:
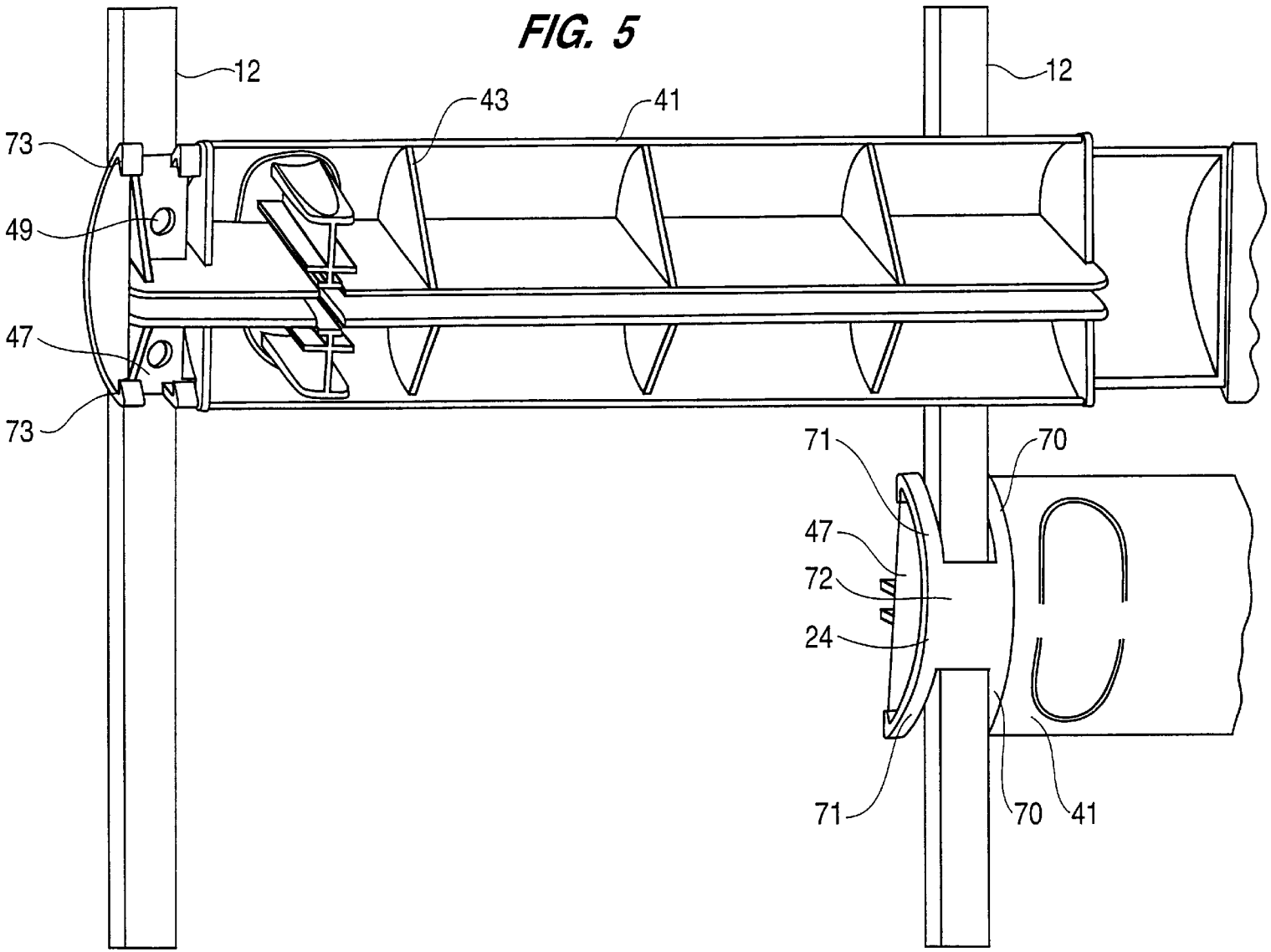
FIG. 5 illustrates how the latch member operates in conjunction with the side support member to secure the side support member to a support structure.

The interaction between the latch member 24, the latch receiving section 47 and the vertical support pole 12 is now explained with reference to FIG. 5. In order to secure the forward portion of the side support member 18 to the vertical support pole 12, first, the support pole 12 is positioned inside the channel 51 formed on the latch receiving section 47 of the side support member 18. The latch member 24 is then positioned so as to straddle the support pole 12, such that the support pole 12 is captured between the latch receiving section 47 and the latch member 24. Force is then applied to the latch member 24 so as to direct the latch member 24 in the direction of the support pole 12. Due to the resilient nature of the latch member 24, as force is applied, the hooks 73 formed on the arcuate members 70, 71 of the latch member 24 engage the underlying surface of the latch receiving section 47 and are forced apart from one another such that the distance between hooks 73 on opposite ends of a given arcuate member 70, 71 increases (i.e., the arcuate members 70, 71 bend outwardly). A sufficient force is applied to the latch member 24 such that the hooks 73 clear the surface of the latch receiving section 47. When this occurs, the arcuate members 70, 71, and therefore the hooks 73, attempt to return to the unflexed state and in the process grab the inner surface of the latch receiving section 47, thereby securing the latch member 24 to the side support member 18. As the support pole 12 is positioned between the latch member 24 and the latch receiving section 47, once the latch member 24 is secured, the latch member 24 in combination with the latch receiving section 47 functions to secure the side support member 18 to the vertical support pole 12.

In the preferred embodiment, the dimensions of the opening formed between the latch member 24 and the latch receiving section 47, and the dimensions of the support pole 12 are selected such that when the latch member 24 is secured, the side support member 18 can support the drawer 16, as well a light load disposed therein, without the side support member 18 sliding downwardly along the vertical support pole 12.

However, in order to guarantee that the side support members 18 will not slide along the vertical support pole 12 even under substantial loads, as stated above, each latch receiving section 47 is supplied with at least one opening 49 for receiving a tension screw, which operates to secure the coupling of the side support member 18 to the support pole 12. More specifically, once the support pole 12 is secured to the side support member 18 as detailed above, the tension screw is inserted into the opening 49. As the screw is inserted, it operates to force the support pole 12 away from the lower surface of the channel 51 and into engagement with the latch member 24, thereby increasing the overall holding strength of the side support member 18 relative to the support pole 12.

The latch member 24 of the present invention can also be removed from the secured position, and then resecured, for example, if the position of the drawers 16 are being rearranged. In order to remove the latch member 24 from the latch receiving section 47, the arcuate members 70, 71 and the hooks 73 of the latch member 24 must be flexed outwardly away from one another until the hooks 73 clear the latch receiving section 47. Once this is done, the latch member 24 is simply removed, and the side support member 18 is free from the support pole 12. The remaining components of the drawer system can be removed by reversing the assembly steps set forth above.

Figure 2:
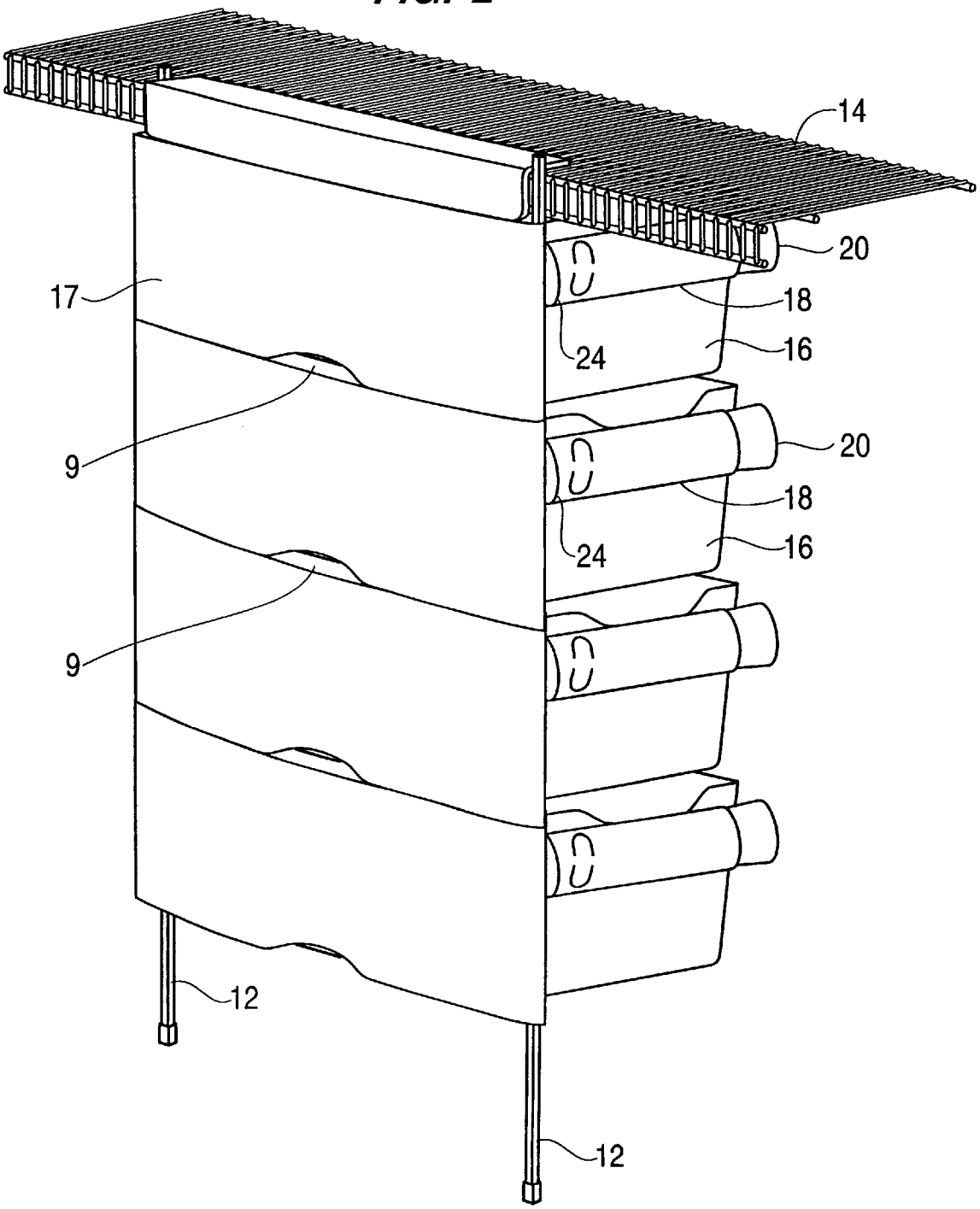
FIG. 2 illustrates essentially the same embodiment as FIG. 1, except mutiple drawers are shown.

FIG. 2 illustrates essentially the same embodiment as shown in FIG. 1, except multiple drawers 16 are shown. As illustrated, a series of four drawers 16 are positioned such that the drawers reside substantially on top of one another, similar to a chest of drawers. Further, the face 17 of each of the front drawers 16 comprises an semi-circular opening 9 which facilities opening the drawer.

The foregoing components of the drawer system are preferably formed from plastic, such as polypropylene or high-impact polystyrene, utilizing an injection molding process.

Furthermore, as illustrated in the figures, the contours and dimensions of the cavities 21, 22, the outer surface of the side support members 18, and the latch member 24 are such that the three components form a substantially continuous, smooth outer surface.

The present invention provides important advantages over the prior art. Most importantly, the novel design of the closet drawer system of the present invention allows the drawer to be compatible with standard closet organizers.

Another advantage is that the design of the present invention minimizes the amount of hardware necessary to assemble each drawer. The present invention also simplifies the process of reconfiguring the drawers.

Yet another advantage is that the present invention eliminates the possibility of misalignment problems arising during the assembly process.

Variations of the foregoing exemplary embodiment are also possible. For example, variations of the structure of the latch member are possible. In one variation, the hooks can be formed so as to extend from the side members thereof.

In another variation, the side support members exhibit a shape other than the arcuate shape disclosed herein. For example, the side support member can exhibit a rectangular outer surface.

In another variation, the side support members can be secured to the back support via hardware such as a screw.

In another variation, the vertical pole, shown herein as having a square cross-section, can be modified so as to exhibit various alternative cross-sections, such as a circular cross-section.

It yet another variation, the front surface of the drawer is formed utilizing a double wall structure, wherein behind the front surface 17 illustrated in the figures, there exists another surface (i.e., a second wall). The configuration of the second wall is such that the drawers can be nested upon on another so as to facilitate moving the drawers from one location to another. In addition, the second wall can be vented.

It is also noted that while various materials can be utilized to form the components of the present invention, as stated, in one embodiment each component is formed as a single plastic member. Of course other materials, such as metal can be utilized.

Of course, it should be understood that a wide range of changes and modifications can be made to the exemplary embodiments described above. It is therefore intended that the foregoing detailed description be regarded as illustrative rather than limiting and that it be understood that it is the following claims, including all equivalents, which are intended to define the scope of this invention.

What is claimed is:

1. A drawer system comprising:

a back support member having an opening utilized to secure said back support member to a surface, said back support member having a first cavity and a second cavity;

a first side support member and a second side support member, each of said side support members having a projection disposed on a first end, said projections operable with said first and second cavities so as to secure said first and second side support members to said back member, each of said side support members having a second end formed so as to be operable as a latch receiving section; and a first resilient latch member and a second resilient latch member, each being operable with one of said latch receiving sections so as to secure one of said second ends of said side support members to a support structure, said first resilient latch member and said second resilient latch member each being operative for clamping one of said second ends of said side support members to said support structure.

2. The drawer system according to claim 1, wherein said first and second latch members each comprise at least two arcuate members coupled together by a mid-section, said arcuate members extending substantially parallel to one another.

3. The drawer system according to claim 2, wherein each of the arcuate members has a first and second end, and comprises a hook disposed on said first and second end, said hooks operative for securing said latch member to said latch receiving section.

4. The drawer system according to claim 2, wherein said latch receiving section further comprises a channel for receiving said support structure, and said mid-section of said latch member functions to retain said support structure in said channel.

5. The drawer system according to claim 1, wherein said latch member can be repeatedly removed and resecured to said latch receiving section.

6. The drawer system according to claim 1, wherein said first side support member and said second side support member each comprise a guide channel, said guide channels operative for receiving and supporting a drawer.

7. The drawer system according to claim 6, further comprising a drawer disposed in said guide channels.

8. A drawer system comprising:

a back support member having an opening utilized to secure said back support member to a surface;

a first side support member and a second side support member, each of said side support members having a first end secured to said back support member such that said first side support member and said second side support member extend substantially parallel to one another, each of said side support members having a second end formed so as to be operable as a latch receiving section; and a first resilient latch member and a second resilient latch member, each being operable with one of said latch receiving sections so as to secure one of said second ends of said side support members to a support structure, said first resilient latch member and said second resilient latch member each being operative for clamping one of said second ends of said side support members to said support structure.

9. The drawer system according to claim 8, wherein said first and second latch members each comprise at least two arcuate members coupled together by a mid-section, said arcuate members extending substantially parallel to one another.

10. The drawer system according to claim 9, wherein each of the arcuate members has a first and second end, and comprises a hook disposed on said first and second end, said hooks operative for securing said latch member to said latch receiving section.

11. The drawer system according to claim 9, wherein said latch receiving section further comprises a channel for receiving said support structure, and said mid-section of said latch member functions to retain said support structure in said channel.

12. The drawer system according to claim 8, wherein said latch member can be repeatedly removed and resecured to said latch receiving section.

13. The drawer system according to claim 8, wherein said first side support member and said second side support member each comprise a guide channel, said guide channels operative for receiving and supporting a drawer.

14. The drawer system according to claim 13, further comprising a drawer disposed in said guide channels.

15. A drawer system comprising:

a back support member having an opening utilized to secure said back support member to a surface, said back support member having a first cavity and a second cavity;

a first side support member and a second side support member, each of said side support members having a projection disposed on a first end, said projections operable with said first and second cavities so as to secure said first and second side support members to said back member, each of said side support members having a second end formed so as to be operable as a latch receiving section, said first side support member and said second side support member each comprises a guide channel;

a first and second latch member each being operable with one of said latch receiving sections so as to secure said second end of said side support members to a support structure; and a drawer supported by and moveable along said guide channels.

16. The drawer system according to claim 15, wherein said first and second latch members each comprise at least two arcuate members coupled together by a mid-section, said arcuate members extending substantially parallel to one another.

17. The drawer system according to claim 16, wherein each of the arcuate members has a first and second end, and comprises a hook disposed on said first and second end, said hooks operative for securing said latch member to said latch receiving section.

* * * * *